United States Patent [19]

Kuhman et al.

[11] Patent Number: 4,885,220

[45] Date of Patent: Dec. 5, 1989

[54] AMORPHOUS SILICON CARBIDE ELECTRORECEPTORS

[75] Inventors: Daniel E. Kuhman, Fairport; Frank Jansen, Webster; Steven J. Grammatica, Penfield, all of N.Y.

[73] Assignee: Xerox Corporation, Stamford, Conn.

[21] Appl. No.: 198,359

[22] Filed: May 25, 1988

[51] Int. Cl.[4] ..... G03G 13/00

[52] U.S. Cl. ..... 430/31; 430/53; 106/286.2; 106/286.8; 428/698

[58] Field of Search ..... 430/84, 85, 86, 31, 430/53; 106/286.2, 286.8; 51/308

[56] References Cited

U.S. PATENT DOCUMENTS

| | | | |
|---|---|---|---|
| 4,038,545 | 7/1977 | Komaki et al. | 430/53 X |
| 4,226,898 | 10/1980 | Ovshinsky et al. | 427/39 |
| 4,377,628 | 3/1983 | Ishioka et al. | 430/57 |
| 4,378,417 | 3/1983 | Maruyama et al. | 430/57 |
| 4,461,820 | 7/1984 | Shirai et al. | 430/65 |
| 4,532,199 | 7/1985 | Ueno et al. | 430/128 |
| 4,668,599 | 5/1987 | Yamazaki et al. | 430/84 |
| 4,696,884 | 9/1987 | Saitoh et al. | 430/58 |

*Primary Examiner*—J. David Welsh
*Attorney, Agent, or Firm*—E. O. Palazzo

[57] ABSTRACT

An electroreceptor comprised of a supporting substrate and hydrogenated amorphous silicon carbide with from about 10 to about 60 atomic percent of carbon, from about 10 to about 60 atomic percent of hydrogen, and from about 10 to about 80 atomic percent of silicon.

25 Claims, 1 Drawing Sheet

AMORPHOUS SILICON CARBIDE ELECTRORECEPTORS

BACKGROUND OF THE INVENTION

This invention is generally directed to electroreceptors, and more specifically the present invention is directed to electroreceptors comprised of amorphous hydrogenated silicon carbide alloys (a-SiC:H) containing between about 10 and 60 atomic percent carbon, between about 10 and 60 atomic percent hydrogen, and between about 10 and 80 atomic percent silicon and processes for the preparation thereof. The aforementioned electroreceptors possess, for example, minimal dark conductivity of less than or equal to $10^{-12}\Omega^{-1}-cm^{-1}$, and specifically from about $10^{-12}\Omega^{-1}-cm^{-1}$ to about $10^{-20}\Omega^{-1}-cm^{-1}$, and negligible photoconductivity of less than or equal to $10^{-9}\Omega^{-1}-cm^{-1}$ at 10 ergs/cm$^2$, and specifically from about $10^{-9}\Omega^{-1}-cm^{-1}$ to about $10^{-20}\Omega^{-1}-cm^{-1}$. In one specific embodiment of the present invention there is provided an amorphous hydrogenated silicon carbide electroreceptor with about 25 atomic percent of carbon, about 35 atomic percent of silicon, and about 40 atomic percent of hydrogen. Other characteristics associated with the mechanically resistant electroreceptors of the present invention include an optical bandgap exceeding or equal to 2 electron volts, and specifically from between about 2.0 and about 3.5 electron volts, and the ability to sustain electrical fields of up to 100 volts per micron with no observable breakdown or loss of electrical potential under ambient light with films that are, for example, between about 10 and 120 microns in thickness. The aforementioned electroreceptors of the present invention are useful in ionographic imaging and printing systems such as those commercially available as the Xerox Corporation 4060 TM and 4075 TM , which utilize an electrically resistive dielectric image receiver, that is an electroreceptor. In one simple form of these systems, latent images are formed by depositing ions in a prescribed pattern onto the electroreceptor surface with a linear array of ion emitting devices or "ion head" creating a latent electrostatic image. Charged toner particles are then passed over these latent images causing the toner particles to remain where charge has previously been deposited, and sequentially this developed image is transferred to a substrate such as paper, and permanently affixed thereto with, for example, radiant, hot roll, pressure fusing or combinations thereof.

Numerous different members have been proposed for imaging processes including, for example, hydrogenated amorphous silicon containing carbon therein, reference for example U.S. Pat. Nos. 4,461,820 and 4,226,898, which discloses an amorphous semiconductor film with desirable photoconductive properties comprised of silicon tetrafluoride, see column 7, line 9. Also, in column 19, line 66, to column 20, line 7, there is disclosed the selection of $SiH_6$ and $C_2H_6$ in an atmosphere of $F_2$ to provide a host matrix of a silicon-carbon alloy, which is altered by the inclusion of hydrogen and fluorine. In the '820 patent, there is described an electrophotographic image forming member with a photoconductive layer of an amorphous material containing at least one of hydrogen atom and halogen atom in a matrix of silicon atom, and wherein the photoconductive layer contains at least one of oxygen atom, nitrogen atom, and carbon atom, see the Abstract of this patent for example. The carbon atoms are present in an amount from about 0.001 to about 20 atomic percent, reference column 3, lines 20 to 23, of the '820 patent. Also of interest are U.S. Pat. Nos. 4,532,199; 4,668,599; 4,378,417; 4,377,628; and 4,696,884 (see for example column 11, lines 30 to 36, wherein it is indicated that the amount of (OCN) contained in the layer region is preferably from about 0.001 to 50 atomic percent). Each of these references, however, relate to electrophotography with a photoconductive imaging member, and do not appear to describe the use of these materials as an electroreceptor that can be selected for ionographic processes, the main aspect of the present invention.

The aforementioned ionographic member device, or electroreceptor of the present invention possesses substantially different properties than that exhibited by, for example, a-SiC:H materials that are selected as a photoreceptor for use in electrophotography. Specifically, electrophotographic imaging processes utilize light to form the latent image on the imaging member, thus a photoconducting member is selected. Also, electrophotography usually requires photoreceptors with high photosensitivity and panchromaticity. Further, in most applications there is substantial dark decay associated with the photoreceptor member because of its semiconducting characteristics. In addition, the ability to transport charge carriers of at least one polarity is needed with photoreceptors. Regarding the a-SiC:H materials utilized as blocking layers, it is generally advantageous for such layers to be able to transport one sign of charge carriers, or to be extremely thin (from about 100 to about 5,000 Angstroms) to permit discharge potential by such processes as tunneling. In this manner, residual charge is not built up at layer interfaces thereby causing poor imaging.

Ionographic imaging in its simplest form, in contrast, creates the latent image by "writing" with an ion head on the surface of the imaging member, which member is to be electrically insulating so that the charge applied by the ion head does not disappear prior to development. Therefore, ionographic receivers possess negligible, if any, photosensitivity. The absence of photosensitivity provides considerable advantages in ionograhic applications. For example, the electroreceptor enclosure does not have to be completely impermeable to light and radiant fusing can be used without having to shield the receptor from stray radiation. Also, the level of dark decay in these ionographic receivers is characteristically low (from 0 to 3V/sec (volts/second) at electrical fields of 10 to 50V/$\mu$m) thus providing a constant voltage profile on the receiver surface over extended time periods. Further, with electroreceptors overall, charge transport of either positive or negative carriers is somewhat limited, with carrier transport ranges being less than about $10^{-10}cm^2/V$.

There are thus important differences in the physical characteristics of the a-SiC:H electroreceptors of the present invention, and known photoreceptors selected for electrophotographic imaging purposes. The a-SiC:H materials utilized in photoreceptors for electrophotography possess, for example, excellent photosensitivity when applied as photogeneration layers and transport only one sign of charge carriers when applied as blocking layers. In contrast, the a-SiC:H electroreceptors of the present invention possess no significant photosensitivity or ability to transport charge, enabling, for example, high charge acceptance ($\geqq$20V/$\mu$m, and specifically from about 50 to 100V/$\mu$m) and a constant voltage profile with time independent of the ambient environment.

Dielectric receivers selected for imaging and printing systems, such as the commerically available Xerox 4060 TM and 4075 TM are characterized by high electrical resistivity, low photosensitivity, and resistance to abrasion and environmental effects. The material selected for these printing systems is comprised of aluminum oxide, which is usually applied as a 30 μm (microns) thick film on a cylindrical receiver. These layers, although adequate for their application, are considered undesirable because of their inherent inhomogeneity. The numerous physical cracks in the material, which unavoidably occur in the thin film deposition process, must be filled with a softer material which does not possess the desirable characteristics of the optimum electroreceptor material, such as extreme hardness and chemical inertness. Furthermore, the oxide materials exhibit an undesirable sensitivity to humidity in the ambient environment causing an uncontrolled loss of, and spreading over the surface of the charge contained in the latent image on the receptor. These characteristics necessitate the use of heater elements incorporated in the electroreceptor device.

Therefore, there remains a need for electroreceptors with improved characteristics. Additionally, and more specifically there remains a need for simple, economical plasma deposited hydrogenated amorphous silicon carbide (a-SiC:H) electroreceptors with between about 10 and 60 atomic percent carbon, between about 10 and 60 atomic percent hydrogen, and between about 10 and 80 atomic percent silicon with minimal dark conductivity of $\leqq 10^{-12}\Omega^{-1}-cm^{-1}$, and specifically, for example, from about $10^{-12}\ \Omega^{-1}-cm^{-1}$ to about $10^{-20}\Omega^{-1}-cm^{-1}$, and negligible photoconductivity of $\leqq 10^{-9}\Omega^{-1}-cm^{-1}$ at 10 ergs/cm$^2$, and specifically, for example, from about $10^{-9}\Omega^{-1}-cm^{-1}$ to about $10^{-20}\Omega^{-1}-cm^{-1}$, and processes for the preparation thereof. Moreover, there remains a need for hydrogenated amorphous silicon carbide electroreceptors with high charge acceptance of $\leqq 20$ V/μm, and specifically, for example, from about 50 to 100 V/μm, and low dark decay of $\geqq 5$ V/sec, and specifically, for example, from about 0 to 5 V/sec at electric fields of about $\geqq 20$ V/μm. There also is a need for a-SiC:H electroreceptors with excellent mechanical properties, particularly hardness and resistance to mechanical wear, enabling the electroreceptor to be selected for extended time periods, exceeding 1,000,000 imaging cycles. In addition, there is a need for a-SiC:H electroreceptors with a low dielectric constant of $\leqq 7$, and specifically, for example, from about 2 to 7, which assists in charging the surface of the receiver. Also, there remains a need for electroreceptors which are not sensitive to humidity, for example, from about 20 to about 80 percent relative humidity, and temperature of the ambient environment.

SUMMARY OF THE INVENTION

It is therefore an object of the present invention to provide certain electroreceptors with many of the avantages indicated herein.

In another object of the present invention there are provided hydrogenated amorphous silicon carbide electroreceptors with between about 10 and 60 atomic percent carbon, between about 10 and 60 atomic percent hydrogen, and between about 10 and 80 atomic percent silicon with minimal dark conductivity of $\geqq 10^{-12}\Omega^{-1}-cm^{-1}$, and specifically, for example, from about $10^{-12}\Omega^{-1}-cm^{-1}$ to about $10^{-20}\Omega^{-1}-cm^{-1}$, and negligible photoconductivity of $\leqq 10^{-9}\Omega^{-1}-cm^{-1}$ at 10 ergs/cm$^2$, and specifically, for example, from about $10^{-9}\Omega^{-1}$-cm$^{-1}$ to about $10^{-20}\Omega^{-1}-cm^{-1}$.

In yet another object of the present invention there are provided hydrogenated amorphous silicon carbide electroreceptors with high charge acceptance of $\geqq 20$V/μm, and specifically for example from about 50 to 100V/μm, and low dark decay of $\leqq 5$V/sec, and specifically, for example, from about 0 to 5V/sec at electric fields of about $\geqq 20$V/μm.

In yet another object of the present invention there are provided hydrogenated amorphous silicon carbide electroreceptors with optical bandgaps of $\geqq 2.0$ eV, and specifically, for example, between about 2.0 and 3.5 electron volts as determined by a Tavc plot which utilizes the straight-line intercept of the $(\alpha h\nu)^{\frac{1}{2}}$ versus hν curve in the absorption region where $\alpha > 10^4 cm^{-1}$.

In another object of the present invention there is a need to provide hydrogenated amorphous silicon carbide electroreceptors with a low dielectric constant of $\leqq 7$, and specifically, for example, of from about 2 to 7 as determined by surface charge (Q) versus voltage (V) measurements with a corotron charging device and an electrostatic surface probe.

A further object of the present invention resides in the provision of hydrogenated amorphous silicon carbide electroreceptors with excellent mechanical characteristics, particularly wear resistance for extended imaging cycles.

Also, an object of the present invention is the provision of hydrogenated amorphous silicon carbide electroreceptors with substantially no sensitivity to humidity and temperature changes which might normally occur in various ambient environment.

Furthermore, in another object of the present invention there are provided simple, economical processes for preparing hydrogenated amorphous silicon carbide alloy electroreceptors by the glow discharge decomposition of silane and carbon containing gases.

Additionally, another object of the present invention resides in the provision of imaging and printing methods with the electroreceptors described herein.

These and other objects of the present invention are accomplished by the provision of certain electroreceptors. More specifically, the present invention is directed to electroreceptors comprised of a supporting substrate, and in contact therewith hydrogenated amorphous silicon carbide alloys as illustrated herein. The aforementioned electroreceptor of the present invention exhibits a number of advantages including, for example, high charge acceptance of $\geqq 20$V/μm, and specifically, for example, from about 50 to 100V/μm; a low dielectric constant of $\leqq 7$, and specifically, for example, from about 2 to 7; a low dark decay of about $\leqq 5$V/sec, and specifically, for example, from about 0 to 5V/sec at electric fields of $\geqq 20$V/μm; minimal dark conductivity of $\leqq 10^{-12}\Omega^{-1}-cm^{-1}$, and specifically, for example, from about $10^{-12}\Omega^{-1}-cm^{-1}$ to about $10^{-20}\Omega^{-1}-cm^{-1}$; negligible photoconductivity of $\leqq 10^{-9}\Omega^{-1}-cm^{-1}$ at 10 ergs/cm$^2$, and specifically, for example, from about $10^{-9}\Omega^{-1}-cm^{-1}$ to about $10^{-20}\Omega^{-1}-cm^{-1}$; and resistance to mechanical abrasion. In one important specific embodiment of the present invention, the electroreceptor is comprised of a cylindrical aluminum support with a thickness of from about 0.1 to about 1 inch, coated with an amorphous hydrogenated silicon carbide alloy layer with a thickness of from about 10 to about 120 μm (microns), and containing approximately 25 atomic percent carbon, 35 atomic percent silicon, and 40 atomic percent hydrogen as determined by analytical methods such as combustion pyrolysis, Auger electron spectroscopy (AES), or secondary ion emission spectroscopy (SIMS), which methods can also be selected generally for determining the percentages of carbon, silicon, and hydrogen. The optical bandgap of the aforesaid electroreceptor of the present invention is from about 2.2 to 2.8 electron volts with dielectric constants of from about 6 to 3. Thin films of this material with thickness from about 10 μm to 120 μm can sustain electrical fields of up to 100 volts per micron with no observable breakdown or loss of electrical potential under ambient light.

A process of creating copies or prints with ionography usually requires for practical applications that the latent image transducer, that is the electroreceptor, be of uniform thickness over a surface area of at least the size of one sheet of standard size paper, for example, (8.5 inches × 11 inches). This is important when providing a uniform electric potential over the receiver when depositing ions, and therefore allowing for uniform development of the image. Although other deposition processes can fabricate a-SiC:H materials with the properties described herein, plasma enhanced chemical vapor deposition (PECVD) permits uniform electroreceptor films with many of the characteristics indicated herein. The general principles of this deposition technique are well known to those skilled in the art of thin film fabrication, reference for example U.S. Pat. Nos. 4,461,820 and 4,668,599, the disclosures of which are totally incorporated herein by reference.

More specifically, the electroreceptors of the present invention comprised of films of a-SiC:H can be prepared by the plasma dissociation of silane ($SiH_4$) or disilanes, and a hydrocarbon gas such as methane, ethane, propane, butane, ethylene, propylene, or acetylene ($C_2H_2$). The fraction of the hydrocarbon in the gas flow [hydrocarbon/(hydrocarbon+$SiH_4$)] can be from about 10 to 85 weight percent and is regulated by mass flow controllers for both the hydrocarbon gas and the $SiH_4$. By varying this fraction and by selecting different hydrocarbon sources, the composition of carbon, silicon, and hydrogen in the deposited films can be systematically changed within percentages indicated herein. For example, hydrogenated amorphous silicon carbide electroreceptors of the present invention can be prepared with a high acetylene ($C_2H_2$) or ethylene ($C_2H_4$) fraction, such as 65 percent contain more carbon (about 35 atomic percent) and hydrogen (about 50 atomic percent), and less silicon (about 15 atomic percent) than films prepared wtih a low fraction of methane ($CH_4$) or ethane ($C_2H_6$), such as 20 percent (about 15 percent carbon, 70 percent silicon, and 15 percent hydrogen) as determined by combustion pyrolysis analysis. Increases in the carbon and hydrogen concentration accompanied by decreases in the silicon concentration will usually increase the bandgap and charge acceptance and decrease the dielectric constant, dark decay and photoconductivity, and mechanical wear resistance.

Specifically, the electroreceptors of the present invention can be prepared in a deposition apparatus that can accomodate an aluminum drum or other suitable supporting substrates such as Mylar, Kapton ®, and the like, including supports such as flexible sleeves of, for example, Kapton ® or nickel. The volume of this apparatus can be between about 15 and 100 liters, and is preferably between 20 and 30 liters for ease in establishing a sufficient vacuum level within a time of 1 to 5 hours. Total gas flow rates can range from about 100 to 1,000 standard cubic centimeters per minute (sccm) for each electroreceptor member prepared, and preferably between about 100 and 300 sccm. An alternating current mode of plasma excitation is utilized due to the electrically insulating nature of the material. These operational modes are well known to those skilled in the art of plasma deposition techniques as indicated herein. The temperature of the aluminum support can be between about 30° and 350° C., and the pressure within the deposition chamber is retained at less than one Torr and preferably at about 300 milliTorr during the deposition. An elecrical power of between about 10 and 300 watts, and preferably about 50 to 150 watts is applied to the gas mixture at reduced pressure, and is terminated when the desired film thickness is obtained.

BRIEF DESCRIPTION OF THE DRAWINGS

For a better understanding of the features of the present invention, the following detailed description of various preferred embodiments of hydrogenated amorphous silicon carbon electroreceptors deposited on a supporting substrate is provided in FIGS. 1 and 2.

Illustrated in FIG. 1 is a partial, schematic cross-sectional view of an electroreceptor of the present invention comprised of a supporting substrate 1 with a thickness of 0.1 to 1 inch, and in contact therewith in a thickness of about 10 to 120 μm (microns) a hydrogenated amorphous silicon carbide layer 3 containing between 10 and 60 atomic percent carbon, between 10 and 60 atomic percent hydrogen, and between 10 and 80 atomic percent silicon. The electroreceptor composition and thickness can be controlled with the methods described herein. This electoreceptor possesses the characteristics indicated herein including a high charge acceptance of $\geqq 20V/\mu m$, and specifically, for example, from about 50 to $100V/\mu m$; low dark decay of $\leqq 5V/sec$, and specifically, for example, from about 0 to 5V/sec at electric fields of about $\geqq 20V/\mu m$; minimal dark conductivity of $\leqq 10^{-12}\Omega^{-1}-cm^{-1}$, and specifically, for example, from about $10^{-12}\Omega^{-1}-cm^{-1}$ to about $10^{-20}\Omega^{-1}-cm^{-1}$; and negligible photoconductivity of $\leqq 10^{-9}\Omega^{-1}-cm^{-1}$ at ergs/cm$^2$, and specifically from about $10^{-9}\Omega^{-1}-cm^{-1}$ to about $10^{-20}\Omega^{-1}-cm^{-1}$.

Figure 1:
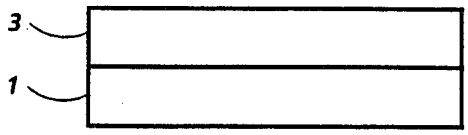
Figure 2:
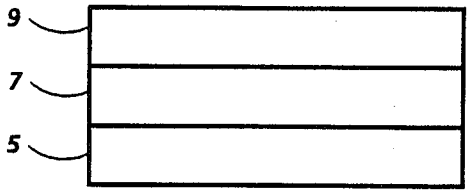

Illustrated in FIG. 2 is a partially schematic cross-sectional view of a preferred electroreceptor of the present invention comprised of an aluminum support 5 of 0.15 inch in thickness, an adjacent a-SiC:H layer 7 with from about 25 atomic percent carbon, about 35 atomic percent hydrogen, and about 40 atomic percent silicon, which layer is of a thickness of from about 80 μm, and a second a-SiC:H layer 9 containing 30 atomic percent carbon, 60 atomic percent silicon, and 10 atomic percent of hydrogen with a thickness of about 5 μm plasma deposited over layer 7 to encapsulate and further protect the device from abrasion.

The composition of the a-SiC:H layers can be adjusted by the method described herein to provide the properties indicated. Thus, a lower concentration of hydrogen in the material provides for a more crosslinked structure which exhibits superior hardness compared to a material which contains many hydrogen terminated bonds and less crosslinking, thus providing improved resistance of the device to abrasion. Also, the composition of layer 9 can contain from about 10 to about 40 atomic percent carbon, from about 40 to about 80 atomic percent silicon, and from about 10 to about 30 atomic percent hydrogen, which layer can be of a thickness of from about 0.1 to about 10 microns.

DESCRIPTION OF THE PREFERRED EMBODIMENTS

Preferred embodiments of the invention will now be illustrated, it being noted that equivalent compositions are also embraced within the scope of the present invention.

The supporting substrate for the electroreceptors of the present invention may comprise an insulating material such as an inorganic or organic polymeric material, including Mylar®, a commercially available polymer; Mylar® in combination with a layer of conductive organic or inorganic material, such as indium tin oxide or aluminum, arranged thereon; a conductive material such as aluminum, chromium, nickel, brass, and the like. The substrate may be flexible or rigid and may have a number of different configurations, such as a plate, a cylindrical drum, a scroll, an endless flexible belt, and the like. Preferably, the substrate is in the form of a rigid cylindrical drum. The thickness of the substrate layer depends on many factors, including economic considerations. Thus, this layer may be of substantial thickness, for example over 1 inch, or of minimal thickness provided that the objectives of the present invention are achieved.

The electroreceptor device of the present invention is preferably comprised of a cylindrical aluminum support (1 or 5) with a thickness of 0.1 to 1 inch; an a-SiC:H layer (3 or 7) which contains between 10 and 60 atomic percent carbon, between 10 and 60 atomic percent hydrogen, and between 10 and 80 atomic percent silicon; and preferably 25 atomic percent carbon, 35 atomic percent silicon and 40 atomic percent hydrogen; and a protective hard overlayer (9) which usually contains less hydrogen than the layers 3 and 7, and preferably contains 30 atomic percent carbon, 60 atomic percent silicon, and 10 atomic percent hydrogen.

The apparatus selected for preparing the electroreceptor members of the present invention is specifically disclosed in U.S. Pat. No. 4,634,647, the disclosure of which is totally incorporated herein by reference, see FIG. 5 for example. The apparatus container, single drum crossflow deposition in one embodiment has a volume of about 21 liters and is pumped by a roots blower backed with a rotary vane pump and can be evacuated to a pressure of less than 1 milliTorr in one minute. Within the container exists a cylindrical electrode of stainless steel with a diameter of 3.0 inches which also serves as the drum mandrel, that is the support for the aluminum drum upon which the a-SiC:H will be deposited. This electrode is electrically grounded and secured to a rotating shaft driven by a mechanical motor, which contains heating elements with connecting wires, connected to a heating source controller, which electrode is surrounded by a stainless steel electrode which is coaxial with the drum mandrel and electrically isolated from the remainder of the deposition apparatus by being seated on a Teflon ring at the bottom of the apparatus, and wherein said electrode has an inner diameter of about 6.0 inches; gas inlet and exhaust slots of about 0.5 inch wide, and about 16 inches in length. The cylinder electrode is connected with an electrical feedthrough on the wall of the deposition apparatus to an r.f. matching network, which in turn is connected to an r.f. power supply. Gas pressure vessels containing silane ($SiH_4$), hydrocarbon gases such as ethylene ($C_2H_4$), acetylene ($C_2H_2$), and ethane ($C_2H_6$) are connected through mass flow controllers to a mixing manifold, which in turn is connected to the deposition apparatus. Also connected between this apparatus and the roots blower vacuum pump is a throttle valve which is connected through a feedback loop to a pressure guage, allowing for the regulation of a preset pressure value within the deposition apparatus. When electrical power is applied therebetween, an electrical discharge is created between the above electrodes, dissociating the gas mixture in the deposition apparatus at a reduced pressure and producing the desired hydrogenated amorphous silicon carbide film on the aluminum drum substrate.

The present invention also encompasses ionographic imaging processes wherein ions are imagewise applied to the surface of the electroreceptor member. Thus, electrostatic images of sufficient electric field and potential are created and retained at the surface of the electroreceptor, and these electrostatic patterns are suitable for development with toner and developer compositions, and no charge additive, reference U.S. Pat. Nos. 4,298,672; 4,338,390; 4,558,108; 4,469,770; and 4,560,635, the disclosures of which are totally incorporated herein by reference; followed by transfer and fixing.

The following examples are supplied to further define various species of the present invention, it being noted that these examples are intended to illustrate and not limit the scope of the present invention. Parts and percentages are by atomic percent unless otherwise indicated.

EXAMPLE I

A homogeneous amorphous hydrogenated silicon carbide electroreceptor was fabricated with the aforementioned single drum, crossflow deposition apparatus. Thus, a first electrode comprised of an aluminum drum substrate, 16 inches long, with an outer diameter of 3.3 inches, and a thickness of 0.15 inch, was inserted over a stainless steel mandrel contained in the deposition apparatus and heated to 230° C. in a vacuum at a pressure of about 1 milliTorr. Also present in this deposition apparatus was a stainless steel electrode as more specifically detailed herein with an inner diameter of 6 inches, gas inlet and exhaust slot of 0.5 inch wide, and 16 inches in length, coaxial with the first electrode. The drum and mandrel were then rotated at three revolutions per minute and subsequently 100 standard cubic centimeters (sccm) of silane ($SiH_4$) and 100 sccm of ethylene ($C_2H_4$) were introduced into the deposition apparatus through a mixing manifold. The pressure was then maintained at 300 millTorr by the adjustable throttle valve. R.f. power of 100 watts as measured on the power supply Model ENI-ACG-5 was then applied to the coaxial electrode.

When 4 hours had elapsed, the power to the coaxial electrode was disconnected, the gas flow terminated, the drum rotation stopped, and the drum cooled to room temperature, followed by removal of the aluminum drum from the deposition apparatus. The thickness of the amorphous hydrogenated silicon carbide layer contained on the aluminum substrate (0.15 inch thick) was determined to be 60 μm, as measured by a Permascope® thickness measuring device. Using combustion pyrolysis analysis, the composition of the deposited hydrogenated amorphous silicon carbide layer was determined to be about 25 atomic percent carbon, 35 atomic percent silicon, and 40 atomic percent hydrogen.

Images or prints were obtained by incorporating this electroreceptor in an ionographic breadboard imaging test apparatus comprised of a scoroton charging device, an ionographic image bar (ion head) capable of delivering ion densities of $50\times10^{-9}C/cm^2$, and developement and cleaning systems that were retrofitted from Xerox Corporation 3100®. The electroreceptor was precharged to −1,400 volts with the scorotron charging device and the ion head biased at +1,200 volts. This provided an approximately −1,200 volts potential difference between the areas of the electroreceptor that were "written on" by the ion head and those which were not. A charge decay rate of about 1V/sec (in the dark) and about 2V/sec (with room lights on) was measured on the electroreceptor surface with an electrostatic voltage surface probe. The images obtained subsequent to the development of the generated images on the electroreceptor with toner particles comprised of a styrene-n-butyl methacrylate copolymer, 90 percent by weight, and carbon black particles, 10 percent by weight, and transfer of the images to paper, were of excellent quality (about 300 spi (spots per inch) resolution), and with no observable background deposits.

EXAMPLE II

An amorphous hydrogenated silicon carbide electroreceptor consisting of two distinct layers, reference FIG. 2, was fabricated by essentially repeating the procedure of Example I. Specifically, the aluminum substrate was heated to 230° C. in a vacuum at a pressure of less than $10^{-4}$ Torr. The drum and mandrel were then rotated at 3 revolutions per minute, and subsequently 100 sccm of $SiH_4$ and 100 sccm of ethylene were introduced into the deposition apparatus through the mixing manifold. The pressure was then maintained at 300 milliTorr with the adjustable throttle valve. An r.f. power of 100 watts was then applied to the coaxial electrode while the drum mandrel and aluminum substrate remained electrically grounded.

When 4 hours had elapsed, the power to the coaxial electrode was disconnected, the gas flow terminated, and the deposition apparatus was maintained at a pressure of about 1 milliTorr for 2 minutes. Subsequently, for preparation of a second hydrogenated amorphous silicon carbide layer, which was deposited on the above prepared hydrogenated amorphous silicon carbon layer, 160 sccm of $SiH_4$ and 40 sccm of ethane ($C_2H_6$) were introduced into the deposition apparatus through the mixing manifold. The pressure was maintained at 300 milliTorr. An r.f. power of 100 watts was then applied to the coaxial electrode while the drum mandrel and aluminum substrate remained electrically grounded.

When 15 minutes had elapsed, the power to the coaxial electrode was disconnected, the gas flow terminated, the drum rotation stopped, and the aluminum drum cooled to room temperature, followed by removal of the drum from the deposition apparatus. The total thickness of the first and second amorphous hydrogenated silicon carbide layer was determined to be 64 μm. The first layer was 60 microns, and the second layer was 4 microns in thickness as measured by a Permascope®. The ethylene prepared material deposited first was determined to contain about 25 atomic percent carbon, 35 atomic percent silicon, and 40 atomic percent hydrogen using combusion pyrolysis analysis. With the same pyrolysis method, the second layer (ethane) deposited was found to contain 15 atomic percent carbon, 70 atomic percent silicon, and 15 atomic percent hydrogen.

This electroreceptor was print tested by repeating the procedure of Example I, and substantially similar results were obtained. Charge decay of the voltage on the electroreceptor was determined to be about 1V/sec both in the dark and with room lights on. Images obtained with this electroreceptor were of excellent quality (equivalent to those obtained in Example I), and the wear resistance of this electroreceptor was found to be exceptional by rotating the drum against a 2 mil thick stainless steel cleaning blade for one million cycles and, detecting no loss with a Permascope® (that is the thickness did not change from 64 microns) of the hydrogenated amorphous silicon carbide material.

Other modifications of the present invention will occur to those skilled in the art subsequent to a review of the present application. These modifications, and equivalents thereof are intended to be included within the scope of this invention.

What is claimed is:

1. An electroreceptor comprised of a supporting substrate and hydrogenated amorphous silicon carbide with from about 10 to about 60 atomic percent of carbon, from about 10 to about 60 atomic percent of hydrogen, and from about 10 to about 80 atomic percent of silicon.

2. An electroreceptor in accordance with claim 1 wherein the optical bandgap of the hydrogenated amorphous silicon carbide is from about 2.0 to about 3.5 electron volts.

3. An electroreceptor in accordance with claim 1 wherein the hydrogenated amorphous silicon carbide possesses a dark conductivity of less than or equal to $10^{-12}\Omega^{-1}-cm^{-1}$, and negligible photoconductivity of less than or equal to $10^{-9}\Omega^{-1}-cm^{-1}$ at 10 ergs/cm$^2$.

4. An electroreceptor in accordance with claim 1 wherein the dielectric constant of the hydrogenated amorphous silicon carbide is less than or equal to 7.

5. An electroreceptor in accordance with claim 1 that sustains electrical fields of up to 100 volts per micron with no observable breakdown or loss of electrical potential when exposed to ambient light.

6. An electroreceptor in accordance with claim 1 wherein the voltage decay on the surface of said electroreceptor is less than or equal to 5V/sec at electrical fields of greater than or equal to 50V/μm.

7. An electroreceptor in accordance with claim 1 wherein the hydrogenated amorphous silicon carbide is of a thickness of from about 1 to about 10 microns.

8. An electroreceptor in accordance with claim 1 wherein the layer of hydrogenated amorphous silicon carbide is prepared by the plasma dissociation of a mixture of a silicon containing gas and a carbon containing gas, or the plasma dissociation of gas molecules containing both silicon and carbon atoms.

9. An electroreceptor in accordance with claim 1 wherein the supporting substrate is aluminum.

10. An electroreceptor in accordance with claim 9 wherein the supporting substrate is between about 0.1 and 1.0 inch thick.

11. An electroreceptor in accordance with claim 1 with a dark conductivity of from about $10^{-12}\Omega^{-1}-cm^{-1}$ to about $10^{-20}\Omega^{-1}-cm^{-1}$.

12. An electroreceptor in accordance with claim 1 with a photoconductivity of from about $10^{-9}\Omega^{-1}-cm^{-1}$ to about $10^{-20}\Omega^{-1}-cm^{-1}$.

13. An electroreceptor in accordance with claim 1 wherein the amorphous hydrogenated silicon carbide contains about 25 atomic percent of carbon, about 35 atomic percent of silicon, and about 40 atomic percent of hydrogen.

14. An electroreceptor comprised of a hydrogenated amorphous silicon carbide with from about 10 to about 60 atomic percent of carbon, from about 10 to about 60 atomic percent of hydrogen, and from about 10 to about 80 atomic percent of silicon.

15. An electroreceptor in accordance with claim 14 wherein the hydrogenated amorphous silicon carbide is deposited on a supporting substrate.

16. An electroreceptor comprised of a first layer of hydrogenated amorphous silicon carbide with from about 10 to about 60 atomic percent of carbon, from about 10 to about 60 atomic percent of hydrogen, and from about 10 to about 80 atomic percent of silicon; and a second layer in contact therewith comprised of hydrogenated amorphous silicon carbide with from about 10 to about 40 atomic percent of carbon, from about 40 to about 80 atomic percent of silicon, and from about 10 to about 30 atomic percent of hydrogen.

17. An electroreceptor in accordance with claim 16 wherein the hydrogenated amorphous silicon carbide layers are deposited on a supporting substrate.

18. An electroreceptor in accordance with claim 17 wherein the substrate is comprised of aluminum.

19. An ionographic process which comprises generating a latent image of the electroreceptor of claim 1; thereafter developing this image; subsequently transferring the image to a suitable substrate; and permanently affixing the image thereto.

20. An ionographic process which comprises generating a latent image on the electroreceptor of claim 14; thereafter developing this image; subsequently transferring the image to a suitable substrate; and permanently affixing the image thereto.

21. An ionographic process which comprises generating a latent image on the electroreceptor of claim 16; thereafter developing this image; subsequently transferring the image to a suitable substrate; and permanently affixing the image thereto.

22. An electroreceptor consisting essentially of a supporting substrate and hydrogenated amorphous silicon carbide with from about 10 to about 60 atomic percent of carbon, from about 10 to about 60 atomic percent of hydrogen, and from about 10 to about 80 atomic percent of silicon.

23. An electroreceptor consisting essentially of a hydrogenated amorphous silicon carbide with from about 10 to about 60 atomic percent of carbon, from about 10 to about 60 atomic percent of hydrogen, and from about 10 to about 80 atomic percent of silicon.

24. An electroreceptor in accordance with claim 1 wherein the dark conductivity thereof is from about $10^{-12}\Omega^{-1}-cm^{-1}$ to about $10^{-20}\Omega^{-1}-cm^{-1}$.

25. An electroreceptor in accordance with claim 1 wherein the charge acceptance is from about 50 to about 100 volts/$\mu$m and the dark decay of from about 0 to about 5 volts/sec at electric fields of about $\geqq 20$ volts/$\mu$m.

* * * * *